United States Patent [19]

Rieckman et al.

[11] Patent Number: 4,683,369

[45] Date of Patent: Jul. 28, 1987

[54] HAND HELD ELECTRIC HAIR DRYER

[75] Inventors: Roger A. Rieckman, Elmhurst; William R. Hemrich, Glen Ellyn; Donald N. Jursich, Chicago, all of Ill.; George C. Crowley, Pinehurst, N.C.

[73] Assignee: John Zink Company, Tulsa, Okla.

[21] Appl. No.: 826,178

[22] Filed: Feb. 5, 1986

[51] Int. Cl.[4] ..... H05B 1/00

[52] U.S. Cl. ..... 219/364; 200/157; 200/302.1; 34/96

[58] Field of Search ..... 219/364, 369, 370, 373; 200/168, 157, 302.1, 302.2, 302.3; 34/96–101, 243 R

[56] References Cited

U.S. PATENT DOCUMENTS

| | | | |
|---|---|---|---|
| 2,740,872 | 4/1956 | Brodsky et al. | 200/168 |
| 3,278,963 | 10/1966 | Bond | 15/22 |
| 3,472,983 | 10/1969 | Satkunas et al. | 200/157 |
| 3,766,352 | 10/1973 | Bigley et al. | 200/169 R |
| 3,839,614 | 10/1974 | Saganowski et al. | 200/321 |
| 3,928,742 | 12/1975 | Rule | 200/302.3 |
| 4,029,996 | 6/1977 | Miffitt | 307/326 |
| 4,270,158 | 5/1981 | Gilardoni et al. | 361/42 |
| 4,276,459 | 6/1981 | Willett et al. | 206/157 |
| 4,309,595 | 1/1982 | Long et al. | 34/96 |
| 4,427,006 | 1/1984 | Nottke | 128/303.14 |
| 4,464,582 | 8/1984 | Aragaki et al. | 307/118 |
| 4,493,975 | 1/1985 | Yamamoto | 219/370 |
| 4,550,358 | 10/1985 | Crowley et al. | 361/42 |

OTHER PUBLICATIONS

European Patent Application No. 0 152 238 (85300676.5) filed Jan. 31, 1985.

*Primary Examiner*—E. A. Goldberg
*Assistant Examiner*—Lincoln Donovan
*Attorney, Agent, or Firm*—Neil M. Rose

[57] ABSTRACT

A portable electric hair dryer having an insulating housing enclosing a motor, fan and heating element with a first switch means for connecting or disconnecting the hair dryer from a source of power and a second switch for controlling the level of heat supplied by the heating element, the first switch being a normally open double pole switch which is completely moisture sealed. The first switch having a mechanical stop associated with a switch actuator to prevent inadvertent actuation of said first switch.

17 Claims, 9 Drawing Figures

HAND HELD ELECTRIC HAIR DRYER

BACKGROUND OF THE INVENTION

The present invention relates to portable hand held electric hair dryers and more specifically relates to a portable electric hand held hair dryer having means to reduce the hazards in normal usage.

Portable hand held electric hair dryers are one of the most popular and largest selling appliances in the world. With the increased consciousness over consumer safety and protection, studies are continuously being made to design all electric appliances so that they are as safe as possible in the hands of the consumer. There are various types of conditions which must be considered in connection with designing an appliance for maximum safety. Initially, the risk of a breakdown in the appliance which would make any exposed metal parts electrically energized so as to injure the user must be considered. With the advent of high temperature resistant plastics which are almost indestructible in normal usage, it has been possible to design most appliances so that there are no conducting parts which might be energized and located where the user could touch them. Thus, the appliance may be designed so that the rigid plastic housing or shell completely encloses the electrical components and protects the user from them.

There are, however, some appliances which are used adjacent to or in proximity to water which may serve to conduct the electricity from the interior of the portable appliance to a grounded user. This type of situation occurs in the kitchen or the bathroom when an appliance which is plugged in is accidentally dropped or immersed in water, thereby exposing the user to injury from the electricity conducted by the water.

The portable hand held electric hair dryer has particularly high risks with respect to accidental immersion in water since it is normally used in the bathroom and frequently around a tub, sink or toilet which may be filled with water. The portable hand held hair dryer is fairly simple in construction, involving a small motor driven fan, exposed resistance heating elements positioned in the path of the air produced by the fan and a switch or switches which turn the appliance on and off and provide various levels of heat. Because of the fact that the electricity is connected directly to the exposed resistance heating elements and the housing has substantial openings to provide access for the air entering and leaving the housing, water may have almost instant access to the electrically energized portions of the hair dryer when it is accidentally immersed in water. Therefore, the accidental dropping of the hair dryer into the tub, sink or toilet can immediately create a potentially lethal situation in which the user, if he is well grounded, may be electrocuted when he attempts to recover the hair dryer from the water. It should also be noted that many of the accidents associated with electric hair dryers have been a result of unsupervised small children who use the hair dryer as a toy and immerse it in the tub in which they are bathing.

The dangers associated with the hair dryer are further compounded by the dangers associated with the hair dryer even when it is shut off if it is still plugged into the power outlet. Many users assume that when and if the hair dryer falls in water when it is not turned on, it may be safely recovered. However, since most hair dryers have neither polarized plugs nor three conductor cords which might provide a measure of safety if used with the proper fused circuits, the user may be faced with the same type of hazard that would be present if the appliance were immersed with the power switch in the on position.

Many different types of solutions have been conceived by various people and companies approaching this problem of consumer safety with respect to hand held portable hair dryers. In some related product areas the elimination of risk of injury from water immersion involved completely sealing the appliances as exemplified by the toothbrush U.S. patents to Bond U.S. Pat. No. 3,278,963 and Satkunas et al U.S. Pat. No. 3,472,983 and in the electrosurgical instruments U.S. patent to Nottke U.S. Pat. No. 4,427,006. However, such an approach is impractical for the hair dryer appliance since the cost of the hair dryer would be escalated tremendously if some sort of electrically sealed heating element were to be used rather than the conventional resistance type element positioned in the stream of cool air.

Other alternative approaches involve the use of various types of sensing means which will interrupt the circuit to the hair dryer in the event that there is water associated with the internal parts of the hair dryer. Disclosures of hair dryers of this type are included in the U.S. patent to Aragaki et al U.S. Pat. No. 4,464,582 and Gilardoni et al U.S. Pat. No. 4,270,158. Another disclosure of a hair dryer having means for sensing the presence of water and disabling the hair dryer is included in the U.S. patent to Crowley, et al. U.S. Pat. No. 4,550,358 assigned to the same assignee as the instant invention.

Another prior art protective circuit for use on a hand held hair dryer is disclosed in the U.S. patent to Miffitt U.S. Pat. No. 4,029,996 which includes a means for sensing the presence of the user and for disabling the power supply when the product is not being held. Another approach to eliminating the risks associated with hand held hair dryers is shown in the U.S. patent to Yamamoto. U.S. Pat. No. 4,493,975 which discloses a wall switch associated with the hair dryer which requires the user to actuate the switch when using the hair dryer and which automatically turns off the switch when the hair dryer is replaced on its supporting bracket. This approach is designed to prevent the user from inadvertently leaving the hair dryer plugged in and shut off in such a way that it might fall into water and become a hazard. The only way the user can shut off the hair dryer of the Yamamoto patent is to replace it on the support stand. All of the foregoing approaches involve fairly complex circuitry which would add considerably to the cost of a hand held hair dryer.

The U.S. patent to Bigley, et al. U.S. Pat. No. 3,766,352 is noted of interest as teaching the concept of a switch having secondary mechanism which must be actuated before the switch itself can be closed. A similar type of mechanism is contemplated as a part of the instant invention.

SUMMARY OF THE INVENTION

The purpose of the present invention is to provide a relatively inexpensive means of substantially eliminating the electrical hazards associated with hand held portable hair dryers. The only basic modification required in the hair dryer is to provide a sealed normally open switch associated with the hair dryer so that if the hair dryer is accidentally immersed in water it does not present any electrically conducting parts to the water whereby the user would be subjected to serious injury or death if he attempted to retrieve the hair dryer from the water. Even if the hair dryer were in use at the time it was dropped into the water, the normally open switch would immediately de-energize the heating element and motor as well as any of the wiring which would be exposed to the water. In one modification of the invention, the normally open switch is provided with an additional latch means which must be actuated before the on-off switch can be closed. This eliminates the possibility of someone accidentally actuating the switch when simply intending to pick the hair dryer up and remove it from its immersed position. These relatively simple and inexpensive modifications to the hair dryer provide essentially the same advantages that many of the more expensive modifications disclosed in the prior art perform.

It is, therefore, an object of the present invention to provide a simple and inexpensive means for protecting the user of a hand held portable hair dryer from injury in the event that the hair dryer is immersed in water.

It is another object of the present invention to provide a hand held portable hair dryer with improved low cost switch means to protect the user from accidental injury or death due to immersion of the hair dryer.

It is another object of the present invention to provide a hair dryer with a sealed on-off switch which is normally open to protect the user from accidental injury in the event of immersion of the hair dryer.

Still another object of the present invention is to provide a hand held portable hair dryer with a normally open sealed on-off switch which has a latch means to prevent its accidental actuation.

Further objects and advantages of the invention will become apparent as the following description proceeds and the features of novelty which characterize the invention will be pointed out in the claims annexed hereto and forming a part of the specification.

Figure 1:
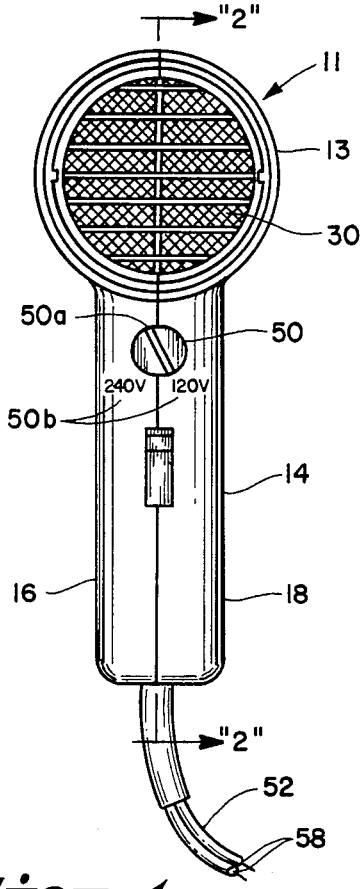
FIG. 1 is a rear elevational view of a hair dryer embodying our invention.
Figure 2:
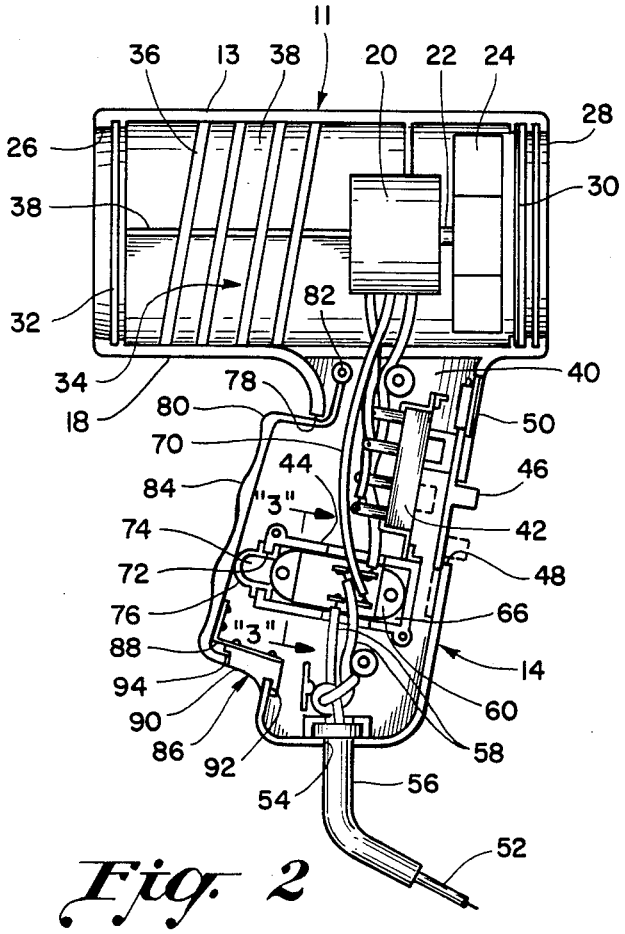
FIG. 2 is a cutaway view of the hair dryer of FIG. 1 taken generally on line 2—2 of FIG. 1 with one housing half removed to expose the interior parts which are shown unsectioned.

Referring now to the drawings, there is shown in FIG. 1 a portable hand held electric hair dryer designated generally by reference numeral 11. The hair dryer 11 includes a barrel portion 13 and a handle 14 which are formed by a pair of abutting housing members 16 and 18. The various elements of the hair dryer 11 are supported in the housing member 18 which will be designated as the rear housing member as shown in FIG. 2.

The hair dryer 11 is provided within the barrel portion on 13 with a low voltage dc motor 20 which has mounted on the end of an armature shaft 22 and axial flow fan 24. When the motor 20 is energized, it rotates in a direction to cause the fan 24 to draw air from the right and force it to the left through the barrel portion 13 and discharge it from an opening 26. An inlet opening 28 is provided in the right hand end of the barrel portion 13 as seen in FIG. 2. The opening 28 is covered by a screen 30 which is intended to prevent the entrance of objects into the interior of the hair dryer 11. Similarly, there is a screen 32 positioned in the opening 26 at the discharge end of the barrel portion 13. As is conventional in hair dryers of this type, there is provided a heater assembly 34 which comprises an elongated coiled resistance wire element 36 supported on a pair of insulating supports 38. Thus, as the air is circulated through the barrel portion 13 by the fan 24, the air is heated by the exposed resistance wire element 36.

As is well known in the art, the resistance wire element comprises a number of tapped coils which may be connected in various ways to obtain various levels of heat. The motor 20 is connected through rectifiers to a segment of the resistance wire element which serves as a voltage divider to povide less than line voltage to the motor 20 in a manner well known in the art.

The handle 14 of the hair dryer 11 is formed by abutting walls of the housing members 16 and 18 to form an enlongated chamber 40 within which two separate switch members 42 and 44 are mounted. The switch 42 is clamped between the front and rear housing members 16 and 18 and is held against displacement by interior walls formed integrally with the housing members 16 and 18.

The switch 42 is a multiple pole switch having three different positions which permits the hair dryer to be operated at two different heat or wattage levels on 120 volts or at a single level when operated at 240 volts. This type of switching arrangement is old and well known in the hair dryer art and forms no part of the present invention. The switch 42 includes a manual speed selector or slide button 46 which extends through an opening 48 so that it may be displaced by the operator through manual manipulation. Also associated with the switch 42 is a voltage selector 50 which may be rotated so as to position the indicator **50*a* adjacent on appropriate indicia 50*b* to adapt the hair dryer 11** to operation at either 120 or 240 volts.

The switch 44 is a completely sealed double pole switch which opens and closes both sides of the two wire power input to hair dryer 11. The hair dryer is provided with a power cord 52 which enters the lower end of the handle 14 through an opening 54, the power cord 52 being associated with a strain relief 56 captured within an end of the handle 14 in a well known manner. The power cord 52 has a pair of insulated conductors 58 which extend to the switch 44.

Reference may be had to U.S. Pat. No. 3,839,614 to Saganowski for a more detailed disclosure of the voltage selector switch 50 and the manner in which it cooperates with the multi-position switch such as 42 to prevent the operation of the hair dryer on the high heat setting when the voltage selector is set for 240 volts. The selector switch 50 simply blocks the slide button 46 from moving to the high heat position when set for 240 volts since the heating elements would be incapable of operating safely at the higher voltage.

Figure 3:
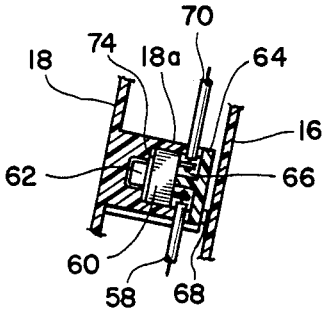
FIG. 3 is an enlarged fragmentary sectional view taken substantially along line 3—3 of FIG. 2.

The switch 44 as shown in FIG. 3 includes a commerically available double pole normally open or momentary switch 60 having a slide actuator 62. The normally open switch 60 is received within a cavity formed by the walls 18*a* of the housing member 18. The walls 18*a*, together with the cover 64, form a cavity 66 within which the normally open switch 60 is captured. The cover 64 is secured in place by screws 68, one of which is shown in FIG. 3. Suitable access openings are provided for the power cord leads 58 to enter the cavity 66 and connect to the normally open switch 60 and further openings are provided for output leads 70 to extend outwardly from the cavity 66 into connection with the heating assembly 34 and the switch 42. The switch 44 is also formed with a outwardly facing opening 72 through which extend a push link 74 and a rubber sealing boot 76. The rubber sealing boot 76 is flexible so that the operator may actuate the normally opened switch 60 by moving the push link 74 lengthwise into the cavity 66 to thereby close the double pole switch 60. The boot 76 has an annular groove formed on its periphery and the walls defining the opening 72 engage this groove thereby sealing the opening against the entrance of water or moisture while at the same time the boot 76 flexes to permit movement of the push link 74 and actuation of the switch 60.

To permit actuation of the switch 44, the handle 14 is formed with an opening 78 within which there is mounted a switch actuator 80. The actuator 80 consists of a elongated member having pivot means 82 at its uppermost end which mounts the actuator 80 for pivotal movement with respect to the handle 14. The actuator 80 is further formed with a finger grip 84 which is engaged by the fingers of the user of the hair dryer 11. Such gripping of the handle results in pivoting the actuator 80 counter clockwise as shown in FIG. 2 to a switch actuating position insofar as the switch 44 is concerned. The rubber boot 76 and the spring means (not shown) associated with the normally open switch 60 rotates the actuator 80 to the switch open position as shown in FIG. 2.

The actuator 80 has a latch means 86 associated with the lowermost end as shown in FIG. 2. The latch means 86 is intended to prevent accidental or inadvertent actuation of the switch 44 when one simply grasps the handle of the hair dryer 11 and has no intention to close the switch 44 to energize the hair dryer. In order to energize the hair dryer, it is necessary to perform a secondary manual operation of releasing the latch 86. The latch 86 comprises an "L" shaped spring 88 which is secured at one leg thereof to the actuator 80 and the other leg thereof is secured to a latch member 90. The latch member 90, as shown in profile in FIG. 2, includes a notch 92 within which the lower edge of the opening 78 in the handle 14 is received. With the latch member 90 in the position shown in FIG. 2, the actuator 80 is restrained against pivotal movement around the pivot means 82. The actuator 80 is formed with an opening 94 which exposes a portion of latch member 90 for manual actuation. Thus, when it is desired to energize the hair dryer 11, the user grasps the handle 14 applying pressure to the actuator 80 and, at the same time, forces the latch member 90 upwardly so that it is displaced out of engagement with the edge of the opening 78 in the handle 14. This permits the actuator 80 to rotate counter clockwise as shown in FIG. 2 to close the switch 44 and allow current to pass from the power cord leads 58 to the switch 42 and the components including the motor 20 and the heater 34. To insure that the switch 44 is completely sealed against the entrance of moisture into the cavity 66, suitable sealing materials, such as a room temperature vulcanizing silicone rubber, are applied around the openings for the leads 58 and 70, as well as around the areas where the cover 64 abuts the walls 18*a* defining the cavity 66.

In the resulting construction, the hair dryer 11 may be completely immersed in water without having any of the live electrical portions exposed to be contacted by the water. Thus, as long as the switch 44 is in its normally open position, there is no risk of electrocution or injury to the user by the immersion of the hair dryer 11 into water while it is plugged in to its power supply. If the hair dryer 11 is inadvertently or intentionally dropped into water contained in the sink, tub or toilet, while it is plugged into a normal utility line outlet, the user may reach in and withdraw the hair dryer with no fear that he will be subjected to a dangerous electric shock. The normally open switch will always return to the power off position thus de-energizing both of the leads 70 exiting the switch 44. In addition, the latch means 86 eliminates any risk that the user might accidentally re-energize the appliance as it is being picked up and withdrawn from its immersed position.

Figure 4:
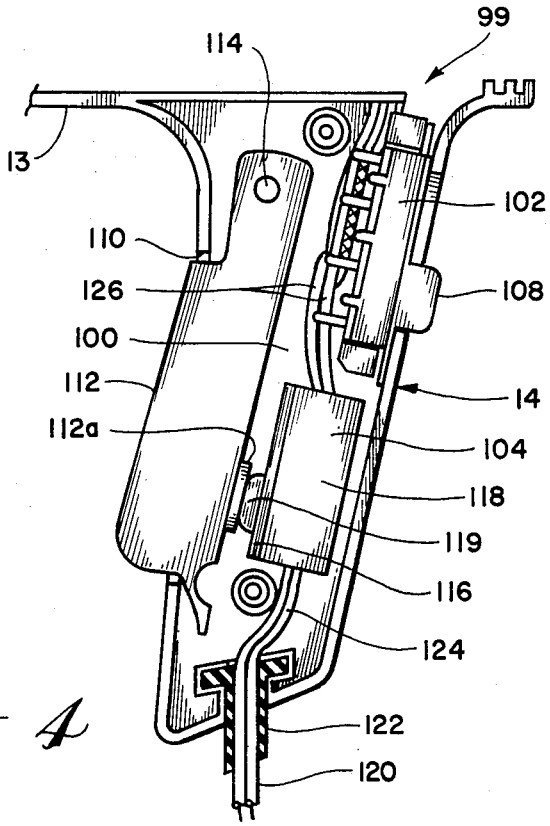
FIG. 4 is a cutaway view of the handle of a hair dryer including an alternative embodiment of our invention showing one housing half removed to expose the interior parts which are shown unsectioned.

Referring to FIG. 4 of the drawings, there is shown an alternative embodiment of the invention which is similar to the embodiment of FIGS. 1 through 3 but omits the latch means 86 and utilizes a different type of sealed switch. The embodiment of FIG. 4 generally designated by reference numeral 99 would include the same housing having a barrel portion 13 and a handle 14, which would enclose a motor 20, a fan 24 and a heater 34. The handle 14 of the alternative embodiment includes a handle cavity 100 within which a heater or wattage level control switch 102 and a sealed normally open switch 104 are positioned. The switch 102 may be substantially identical to the switch 42 of the embodiment of FIGS. 1 to 3, having a voltage selector (not shown) and a heat level selector 108. The handle 14 is formed with an opening 110 within which an actuator 112 is mounted for pivotal movement around a pivot pin 114 which is fixed with respect with the handle 14. Thus finger pressure of the hand of a user on the actuator 112 causes the actuator to rotate counter clockwise as shown in FIG. 4 to actuate the switch 104.

The switch 104 is formed by a front housing member 116 and a cup-shaped rear housing member 118. The housing member 116 is formed with an opening closed by a flexible diaphragm member 119 which is sealed around its periphery to the member 116. The housing member 118 has side walls and a bottom forming a box-like element having one open side which is closed by the number 116 to form a chamber within which a sealed double pole, normally open switch is mounted.

The embodiment of FIG. 4, hair dryer 99, also includes a two conductor power cord 120 provided with a strain relief 122. The power cord 120 terminates in insulated lead wires 124 which extend into the sealed switch 104 where they are connected to the double pole normally open switch. Leads 126 extending from the switch 118 connect to the switch 102 and the heater assembly and motor of the hair dryer 99. The switch actuator 112 is formed with a pad portion 112*a* which engages the flexible diaphragm 119. When pressure is applied to the actuator 112 as by gripping the handle 14, the actuator 112 rotates counterclockwise as viewed in FIG. 4 around the pivot 114 causing the diaphragm 119 to be deflected and the switch 118 to be closed. Upon release of the actuator 112, switch 118 returns to its normally open position. The completely sealed switch 118 being a normally open switch provides most of the safety characteristics described above in connection with the embodiment of FIGS. 1–3 but does not include a safety stop which restrains the actuator against inadvertent movement to a switch closing position.

Figure 5:
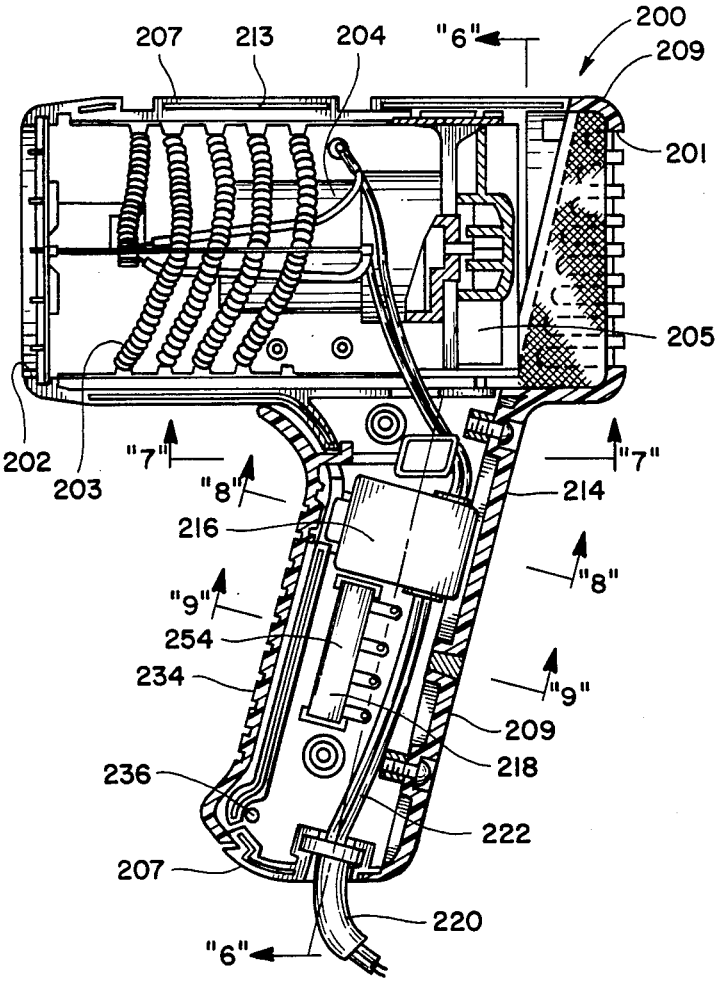
FIG. 5 is a cutaway view similar to FIG. 3 of a hair dryer embodying a further alternative embodiment of our invention showing one housing half removed to expose the interior parts which are shown unsectioned.

There is shown in FIGS. 5 through 9 a further embodiment of our invention. The hair dryer of FIGS. 5 through 9 designated generally by reference numeral 200 includes a barrel portion 213 and a handle 214. As in connection with the earlier embodiments, the barrel portion 213 includes the typical hair dryer structure of air inlet and outlet openings 201 and 202, respectively, a resistance heating element 203, a motor 204 and fan 205. The barrel portion 213 and handle 214 are formed by a rear housing member 207, a front housing member 208 and a closure member 209. The closure member 209 defines the back of the handle and the air inlet openings 201, as best shown in FIG. 5. The members 207 and 208 fit together to form the main part of the barrel portion 213 and the handle 214.

The hair dryer 200 includes a sealed switch 216 and a three position switch 218 which controls the various heat levels at which the hair dryer is operated. As in connection with the earlier embodiments, the sealed switch 216 is connected to a power cord 220 by sealed twin conductors 222 so that when the switch 216 is in the open or off position there is no risk of electrical leakage or electrocution when the hair dryer 200 is accidentally immersed in water. As in the earlier described embodiments, the switch 216 is a normally open, double pole switch so that all the elements, including the motor 204 and heating element 203 connected on the side away from the power cord 220, are completely de-energized when the switch 216 is in the open position.

Rather than using a single double pole switch, one could employ two commercially available single pole, normally open switches mechanically connected together to operate together, each opening and closing one side of the line.

The switch 216 includes a plastic enclosure 224 within which is mounted a commercially available, normally open, double pole switch 226 having a slide type plunger actuator 228. The switch 226 is sealed in an enclosure provided by the cup-shaped plastic member 224 and a closure boot 230. The boot 230 is sealed to the open end of the cup-shaped plastic member 224 and is formed of a flexible material so that it may deflect to permit actuation of the plunger 228. As is best shown in FIGS. 5 and 8, the sealed switch 216 is mounted within the handle 214 with the boot 230 facing toward the front of the handle 214.

Figure 7:
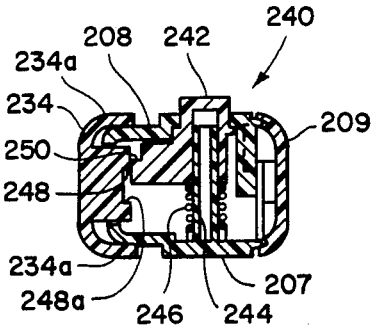
FIG. 7 is a sectional view taken along line 7—7 of FIG. 5 assuming FIG. 5 showed the complete hair dryer.

The handle 214 as explained above is formed by the housing members 207 and 208 and the closure member 209. Located at the forward portion of the handle, or on the left as viewed in FIG. 5, there is a pivotally mounted switch actuator 234. As is best shown in FIGS. 7, 8 and 9, the actuator 234 is somewhat channel shaped having side walls 234*a* which are in sliding engagement with complementary wall portions on members 207 and 208. The switch actuator 234 is pivoted at 236 at the lower front portion of the handle as shown in FIG. 5. Thus, as the user grasps the handle 214, the fingers encircle the switch actuator 234 and tend to pivot the actuator 234 in a clockwise direction as shown in FIG. 5.

Figure 8:
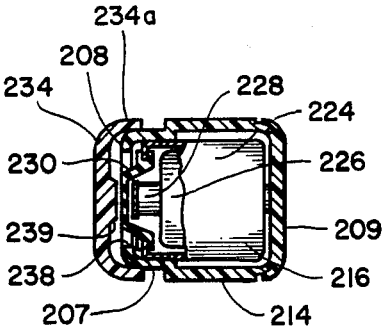
FIG. 8 is a sectional view taken along line 8—8 of FIG. 5 assuming FIG. 5 showed the complete hair dryer.
Figure 9:
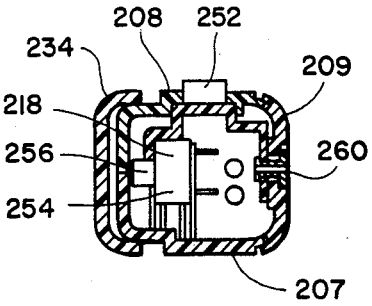
FIG. 9 is a sectional view taken along line 9—9 of FIG. 5 assuming FIG. 5 showed the complete hair dryer.

Turning to FIG. 8, it is noted that the switch 216 with its closure boot 230 projects into an opening 238 where the boot 230 may be engaged by a projection 239 extending from the central channel portion of the switch actuator 234. Thus, when the switch actuator 234 is pivoted clockwise, the projection 239 engages the boot 230 of the switch 216 causing the double pole, double switch to be closed. This permits power from the cord 220 to be delivered to the various components, including the switch 218, the heater 203 and the motor 204.

The hair dryer 200 is also provided with a safety lock 240 which prevents inadvertent actuation of the switch 216. As best shown in FIG. 7, the safety lock 240 includes a manually actuable button 242 which is supported for movement perpendicular to the handle 214 by a post 244 which extends from the rear housing member 207. A spring 246 received on the post 244 bears against the button 242 urging it to its outermost position as shown in FIG. 7. Also as shown in FIG. 7, there is a stop member 248 formed on the interior of the switch actuator 234. The stop member 248 has a centrally located notch 248*a* which is adapted to receive a projection 250 formed on the button 242 when the button 242 is in its depressed position.

When the button 242 is in its normal rest position, the projection 250 is engaged by the stop 248, thereby preventing the switch actuator 234 from being rotated to a position in which it closes the switch 216. It is not until the button 242 is depressed inwardly that the projection 250 is positioned so that it coincides with the notch 248*a* on the stop 248, thereby permitting the switch actuator 234 to pivot sufficiently to close the switch 216. The relationship between the button 242 and the switch actuator 234 is such that the user of the hair dryer must consciously perform the two separate functions of depressing the button 242 and squeezing the handle 214 along with the switch actuator 234 in order to effect closure of the switch 216.

Figure 6:
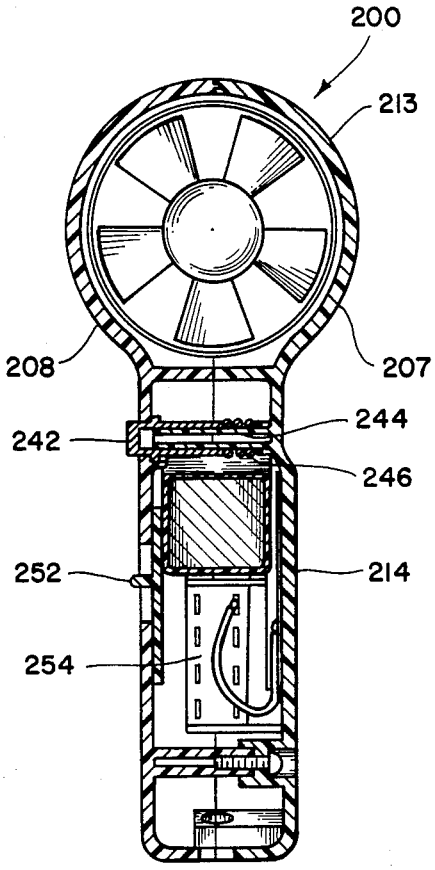
FIG. 6 is a sectional view taken along line 6—6 of FIG. 5 assuming FIG. 5 showed the complete hair dryer.

The switch 218 is formed with an actuator slide or button 252 as is shown in FIGS. 6 and 9. The switch 218 includes a commercially available three position slide switch 254 having a slide actuator 256 which is coupled to the button 252. The hair dryer 200 is also provided with the high and low voltage selector 260 which comprises a well known type of selector which limits the movement of the button 252 when the selector 260 is in the high voltage position.

The switch lock-out mechanism 240 provides a simple and effective means of preventing accidental actuation of the switch 216 as a consequence of an operator merely taking hold of the hair dryer 200 by the handle without intending to actuate the switch. Therefore, it is required that the operator go through the motions of separately depressing the button 242 of the lock-out mechanism 240 before the switch actuator 234 may be rotated to the switch closing position. The hair dryer 200, like the embodiment of FIGS. 1 to 3, has the normally open switch 216 sealed, but the three-position switch to control the heat levels of the hair dryer is unsealed as are the connections to the heater and motor which are located away from the power cord separated by the sealed normally open switch 216.

What is desired to be secured by Letters Patent of the United States is:

1. A portable electric hair dryer comprising a housing of electrically insulating material having air inlet and outlet openings, a motor driven fan mounted within said housing for drawing air into said housing through said inlet opening and for exhausting said air through said outlet opening, a resistance heater mounted in said housing and located in the stream of air circulated into and out of said housing by said fan, a two conductor electrical power cord connected at one end to said housing to supply electricity to said motor and said heater and having a plug connector at the other end, a normally open double pole switch mounted on said housing and connected to said power cord and said motor and said heater to control the flow of power to said motor and said heater, said double pole switch being completely sealed against the entrance of water if the hair dryer is immersed in water, said power cord having a water impermeable sheath extending from said plug connector to the entrance of said power cord into said switch whereby all of the electrically energized parts of said hair dryer are sealed against contact with water in the event of the hair dryer being immersed in water when said power cord is connected to a source of electrical power.

2. The hair dryer of claim 1 wherein said motor and said heater are provided with switching means in said housing to connect said heater to provide various different levels of heat to the air circulated through said housing, said switching means being unsealed against the entrance of water but being connected to said power cord through said double pole switch.

3. The hair dryer of claim 2 wherein said switching means includes means for adapting said motor to operate selectively on either one of two voltages, one of which is substantially twice the other.

4. The hair dryer of claim 1 wherein said housing is provided with a manually actuable lever which is rotated into said housing to close said normally open switch, said lever being biased outwardly of said housing to a rest position in which said double pole switch is open, a latch for preventing movement of said lever to the switch closing position, said latch being accessible for manual actuation to an inoperative position in which it no longer restricts said lever from rotation from the rest position to a switch closing position.

5. The hair dryer of claim 4 wherein said housing is formed with a cylindrical body portion containing said motor and said heater and with handle which extends laterally from said body portion, said handle having an opening extending lengthwise thereof, said manually actuable lever being mounted in said handle opening whereby gripping of said handle in the hand of the user urges said lever toward the switch closed position, said latch being supported on said lever at an end remote from the end which is pivoted to said housing; spring means biasing said latch into locking engagement with said housing, said latch being exposed for manual actuation in an opening between said lever and said housing.

6. The hair dryer of claim 4 wherein said housing is formed with a cylindrical body portion containing said motor and said heater and with a handle which extends laterally from said body portion, said manually actuable lever being mounted on said handle whereby gripping of said handle in the hand of a user urges said lever toward the switch closed position, a manually operable stop means for preventing movement of said lever toward the switch closing position, said stop means being mounted for movement between a first position immobilizing said lever and a second position in which said lever is free to move to said switch closing position, means biasing said stop means to said first position, said stop means being positioned out of contact with said user's hand in a normal handle gripping position but being positioned on said handle for easy manual movement from said first to said second position.

7. The hair dryer of claim 6 wherein said stop means comprises a slidably mounted button which is supported in said handle for movement transverse to the direction of said lever, said button being positioned at the end of said handle adjacent the body portion above the portion of the handle gripped by the user.

8. The hair dryer of claim 1 wherein said housing is formed with a sealed recess within which said normally open switch is enclosed, said recess having an opening in one wall which is sealed by a cup-shaped flexible boot, a switch actuating link extending from said switch into said boot, said link being slidable lengthwise by the action of said lever against said boot to close said normally open switch.

9. A portable electric hair dryer comprising a housing of electrically insulating material having a tubular portion with an air inlet at one end and an air discharge at the other end, said housing having a handle extending laterally from said tubular portion, said handle being of a size suitable for being gripped by the hand of a user, a motor driven fan and an electrical heating element mounted in said housing to circulate and heated air passing lengthwise through tubular portion from said inlet to said outlet, normally open switch means in said handle for controlling electrical power to said motor and said heater, a hand grip switch operating member including an elongated lever which is pivoted at one end and extends lengthwise of said handle, said lever being mounted for limited pivotal movement between a switch closing position and a switch open position, means biasing said lever to said switch open position, a two conductor power cord having a plug connector at one end and having the other end extending into said handle where it is connected to said switch means, said switch means including a double pole normally open switch which is sealed within a water tight compartment, said power cord extending through an opening into said compartment for connection to said switch, said cord and the opening through which it extends into said compartment being sealed against the entrance of water, a flexible wall means defining a part of said compartment; means connected to said lever to operate said switch through said flexible wall means.

10. The hair dryer of claim 9 wherein said water tight compartment is formed by a pair of complementary members of insulating material which fit together to form said compartment, one of said members supporting a resilient diaphragm, said elongated lever having means engaging said diaphragm to close said switch when lever is moved to said switch closing position.

11. The hair dryer of claim 9 including a second switch mounted in said handle for controlling the level of heat output from said heater, conductors electrically connecting said second switch in series with said normally open switch and said motor and said heater.

12. The hair dryer of claim 9 including latch means to restrain movement of said switch operating member, said latch means having manually operable means accessible from the exterior of said housing for moving said latch means from a first member restraining position to a second disengaged position in which said operating member may be pivoted to said switch closing position.

13. The hair dryer of claim 12 wherein said latch means comprises a latch member supported by said handle for slidable movement, spring means biasing said latch member to said first restraining position, said latch member in said first restraining position being located in the path of movement of said switch operating member at a point remote from said pivoted one end, slidable movement of said latch member to said second disengaged position locates said latch member out of the path of said switch operating member whereby said switch operating member is pivotal to said switch closing position.

14. The hair dryer of claim 13 wherein said hand grip switch operating member comprises an elongated channel shaped member which extends lengthwise of said handle with said one end pivoted at the end of said handle remote from said tubular portion, said switch means and said latch means being positioned in said handle at the end adjacent said tubular portion.

15. The hair dryer of claim 14 wherein said latch member is mounted in said handle for slidable movement in a direction normal to the plane in which said switch operating member pivots, said latch member being positioned on said handle above the portion of the handle gripped by the user so that the latch member cannot be actuated by the hand of the user when gripping said handle.

16. A portable electric hair dryer comprising a housing of electrically insulating material having air inlet and outlet openings, a motor driven fan mounted within said housing for drawing air into said housing through said inlet opening and for exhausting said air through said outlet opening, a resistance heater mounted in said housing and located in the stream of air circulated into and out of said housing by said fan, said housing having a handle extending laterally from the portion of the housing enclosing said motor fan and heater, a two conductor electrical power cord connected at one end to said handle to supply electricity to said motor and said heater and having a plug connector at the other end, normally open double pole switch means mounted on said handle and connected to said power cord and said motor and said heater to control the flow of power to said motor and said heater, said double pole switch means being completely sealed against the entrance of water, a manually operable switch actuator which is engaged by the hand of the user in gripping said handle causing said actuator to close said switch means, said power cord having a water impermeable sheath extending from said plug connector to the entrance of said power cord into said switch means whereby all of the electrically energized parts of said hair dryer are sealed against contact with water in the event of the hair dryer being immersed in water when said power cord is connected to a source of electrical power.

17. The hair dryer of claim 1 wherein said motor and said heater are provided with switch means in said handle to connect said heater so as to provide various different levels of heat to the air circulated through said housing, said switching means being unsealed against the entrance of water but being connected to said power cord through said double pole switch.

* * * * *